US012035766B2

(12) United States Patent
Higbie

(10) Patent No.: US 12,035,766 B2
(45) Date of Patent: Jul. 16, 2024

(54) SYSTEMS AND METHODS FOR SUPPORTING A FACE MASK

(71) Applicant: Marcy Lynn Higbie, Houston, TX (US)

(72) Inventor: Marcy Lynn Higbie, Houston, TX (US)

( * ) Notice: Subject to any disclaimer, the term of this patent is extended or adjusted under 35 U.S.C. 154(b) by 321 days.

(21) Appl. No.: 17/228,645

(22) Filed: Apr. 12, 2021

(65) Prior Publication Data

US 2021/0315294 A1 Oct. 14, 2021

Related U.S. Application Data

(60) Provisional application No. 63/009,334, filed on Apr. 13, 2020.

(51) Int. Cl.
*A41D 13/11* (2006.01)

(52) U.S. Cl.
CPC ..... *A41D 13/1161* (2013.01)

(58) Field of Classification Search
CPC . A45D 8/02; A45D 8/34; A45D 8/004; A45D 8/002; A45D 8/24; A45D 8/36; A41D 13/1161; A41D 13/11; A41D 13/1107; A41D 13/1169; A41D 13/1176; A41D 13/05; A41D 13/00; A61M 16/0605; A61M 16/0683; A61M 16/06; A41G 5/0093; A42B 7/00; A42B 5/00; A42B 3/14; A62B 18/08; A62B 18/084; A62B 23/025; A62B 17/04; A62B 18/00; A62B 17/00; A44B 99/00; A61F 9/02; A61F 9/04

See application file for complete search history.

(56) References Cited

U.S. PATENT DOCUMENTS

2005/0103344 A1* 5/2005 Cheng ..... A41D 13/1161 128/206.13
2013/0042880 A1* 2/2013 Arpey ..... A45D 8/12 132/200
2015/0053204 A1* 2/2015 Baiko ..... A61M 16/0683 128/201.23

FOREIGN PATENT DOCUMENTS

JP 2018145548 A * 9/2018

OTHER PUBLICATIONS

Matawari, "Face mask", Sep. 20, 2018, All pages (Year: 2018).*

* cited by examiner

*Primary Examiner* — Tarla R Patel

(57) ABSTRACT

A face mask support assembly includes a clip portion and an engagement portion. The clip portion is configured to attach to hair of a user. The engagement portion is coupled to the clip portion and is configured to engage one or more ties of a face mask to thereby support the face mask on the user.

13 Claims, 5 Drawing Sheets

SYSTEMS AND METHODS FOR SUPPORTING A FACE MASK

CROSS-REFERENCE TO RELATED APPLICATION

This application claims priority to and the benefit of U.S. Provisional Application No. 63/009,334, entitled "SYSTEMS AND METHODS FOR SUPPORTING A FACE MASK," filed Apr. 13, 2020, which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A face mask may include a face portion that covers at least a portion of a face of a user. The face mask may also include one or more ties that are configured to tie or otherwise couple the face mask to the user to maintain the face portion over at least the portion of the face of the user. For example, the face mask may include a first tie on a first lateral side of the face mask and a second tie on a second lateral side of the face mask, and the first tie and the second tie may be configured to loop around ears of the user to couple the face mask to the user.

SUMMARY

Certain embodiments commensurate in scope with the originally claimed subject matter are summarized below. These embodiments are not intended to limit the scope of the claimed subject matter, but rather these embodiments are intended only to provide a brief summary of possible forms of the disclosure. Indeed, the disclosure may encompass a variety of forms that may be similar to or different from the embodiments set forth below.

In some embodiments, a face mask support assembly includes a clip portion configured to attach to hair of a user and an engagement portion coupled to the clip portion. The engagement portion is configured to engage one or more ties of a face mask to thereby support the face mask on the user.

In some embodiments, a face mask kit includes a face mask comprising a first tie on a first lateral side of the face mask and a second tie on a second lateral side of the face mask. The face mask kit also includes a clip portion configured to attach to hair of a user and an engagement portion coupled to the clip portion. The engagement portion is configured to engage the first tie and the second tie of the face mask to thereby support the face mask on the user.

In some embodiments, a method of applying a face mask to a user includes coupling a clip portion of a face mask support assembly to hair of a user, positioning the face mask on a face of the user, and engaging ties of the face mask with an engagement portion of the face mask support assembly.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
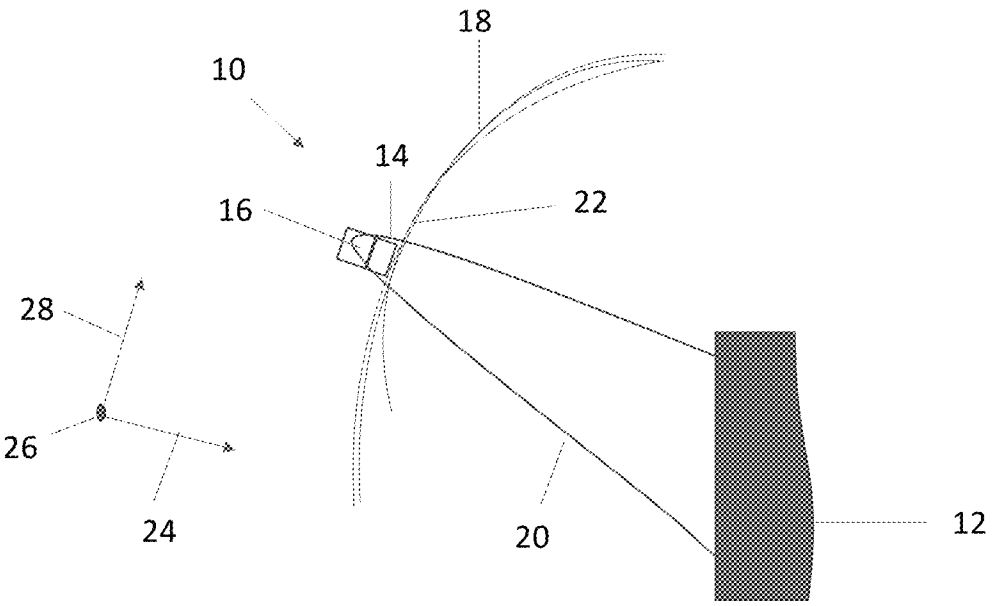
FIG. 1 is a schematic side view of a face mask support assembly that may be used to couple a face mask to a user, in accordance with embodiments of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As noted above, a face mask (e.g., face covering) may include a face portion that covers at least a portion of a face of a user. The face mask may also include one or more ties (e.g., strings, ropes, ribbons, wires, loops) that are configured to couple the face mask to the user to maintain the face portion over at least the portion of the face of the user. For example, the face mask may include a first tie on a first lateral side of the face mask and a second tie on a second lateral side of the face mask.

It is presently recognized that it may be desirable to couple the face mask to the user without looping the one or more ties around the ears of the user and/or to generally provide improved comfort for the user, for example. Accordingly, the present disclosure relates generally to a face mask support assembly that includes a clip portion that is configured to attach onto (e.g., clip into) hair of the user and an engagement portion that is configured to engage the one or more ties of the face mask to thereby couple the face mask to the user. It should be appreciated that the clip portion and the engagement portion disclosed herein may have any of a variety of configurations or forms that enable the face mask support assembly to couple the face mask to the user.

Furthermore, the face mask support assembly may be configured for use with any type of face mask, such as a medical mask, a surgical mask, a respirator mask, a veil, or the like. The face mask support assembly may be configured for use with a disposable face mask (e.g., one-time use) and/or a reusable face mask. The face mask support assembly may be low-cost, which may make the face mask support assembly particularly useful for use with the disposable face mask because the face mask support assembly may be discarded with the disposable face mask.

With the foregoing in mind, FIG. 1 is a schematic side view of a face mask support assembly 10 that may be used to couple a face mask 12 (e.g., face covering) to a user. As shown, the face mask support assembly 10 includes a clip portion 14 and an engagement portion 16. When the face mask support assembly 10 and the face mask 12 are worn together by the user, the clip portion 14 is clipped into and attached onto hair 18 of the user, and the engagement portion 16 is engaged with and holds ties 20 (e.g., strings, ropes, ribbons, wires, loops) of the face mask 12 to thereby couple the face mask 12 to the user.

In the illustrated embodiment, the face mask support assembly 10 is positioned on a back of a head 22 of the user, such that the face mask support assembly 10 is generally positioned to be opposite the face mask 12 when the face mask assembly 10 and the face mask 12 are worn together by the user. However, it should be appreciated that the face mask support assembly 10 may be positioned at any suitable portion of the head 22 of the user to support the face mask 12. Furthermore, multiple face mask support assemblies 10 may be worn by the user to support the face mask 12. For example, a first face mask support assembly 10 may be positioned (e.g., on a first lateral side of the head 22 of the user) to support a first tie 20 of the face mask 12, and a second face mask support assembly 10 may be positioned (e.g., on a second lateral side of the head 22 of the user) to support a second tie 20 of the face mask 12. To facilitate discussion, the face mask support assembly 10 and its components may be described with reference to a first axis 24 (e.g., longitudinal axis), a second axis 26 (e.g., lateral axis), and a third axis 28 (e.g., vertical axis).

Figure 2:
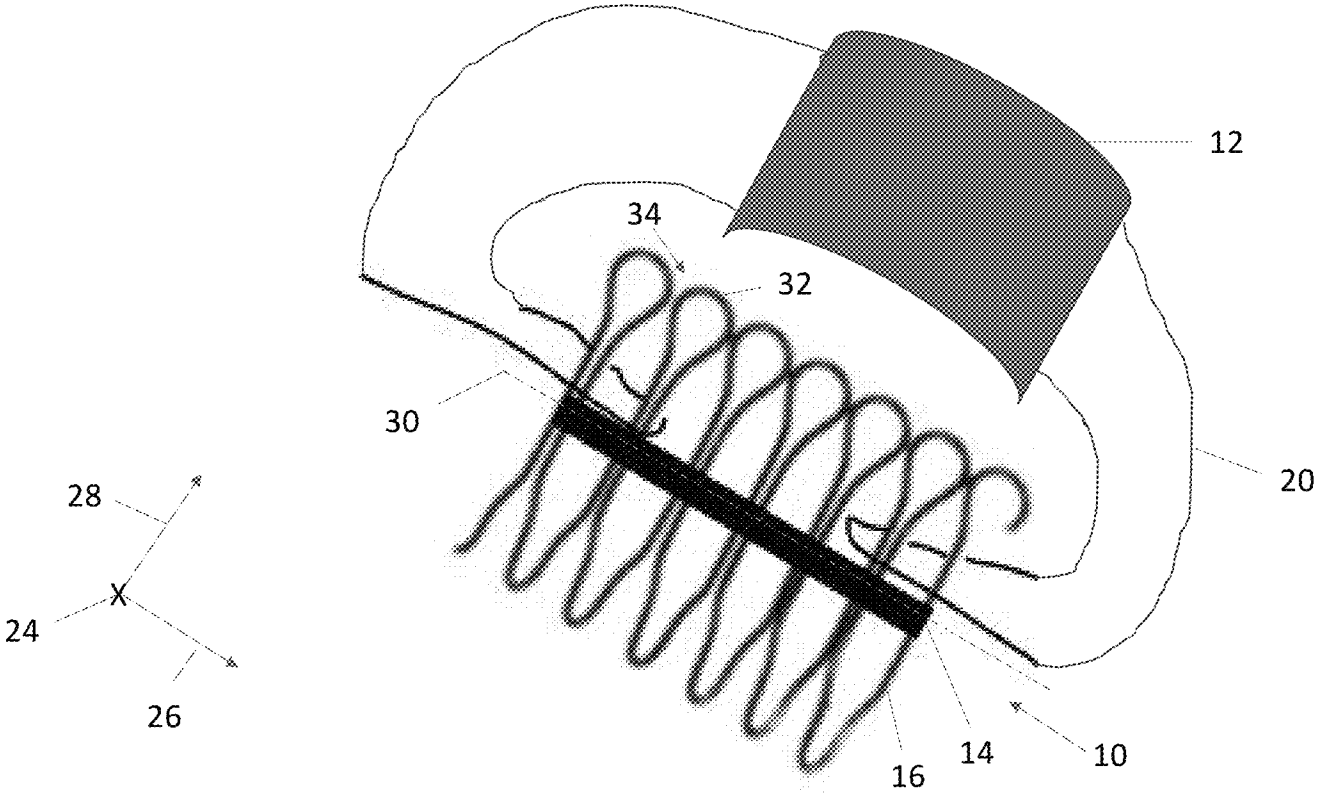
FIG. 2 is a perspective rear view of the face mask support assembly of FIG. 1, wherein the face mask support assembly includes a clip portion and a comb portion, in accordance with embodiments of the present disclosure.

FIG. 2 is a perspective rear view of an embodiment of the face mask support assembly 10 that may be used to couple the face mask 12 to the user. The face mask support assembly 10 includes the clip portion 14 and the engagement portion 16, which is a comb portion (e.g., comb). The clip portion 14 is configured to attach onto hair of the user, and the engagement portion 16 is configured to engage the ties 20 of the face mask 12 to thereby couple the face mask 12 to the user. At least some of the engagement portion 16 may also engage the hair and facilitate attachment onto the hair of the user (e.g., to assist the clip portion 14 or to replace/act as the clip portion 14). As noted above and as shown in FIG. 2, the ties 20 may include a first tie on a first lateral side of the face mask 12 and a second tie on a second lateral side of the face mask 12. In some embodiments, the ties 20 may be coupled to the face mask 12 so as to form loops. The ties 20 may be any suitable material and/or may have elastic properties.

The clip portion 14 and the engagement portion 16 may be coupled to one another (e.g., via adhesive, welds, fasteners, or integrally-formed as one piece). The engagement portion 16 may be coupled to and/or may be positioned on a rear side of the clip portion 14 (e.g., stacked along the longitudinal axis 24; the rear side that faces away from the head of the user when the face mask support assembly 10 is on the user). However, the engagement portion 16 may extend from and/or may be positioned on other sides or surfaces of the clip portion 14. For example, the clip portion 14 may include arms that rotate relative to one another to adjust the clip portion 14 from a closed configuration of FIG. 2 to an open configuration, and the engagement portion 16 may be coupled to and/or may be positioned between the arms (e.g., along the longitudinal axis 24) while the clip portion 14 is in the closed configuration.

As shown, the clip portion 14 may extend along (e.g., align with) and/or be located proximate to a center line 30 (e.g., midline; laterally-extending center line) of the engagement portion 16. In this configuration, some of the engagement portion 16 extends away from the clip portion 14 in a first direction along the vertical axis 28, while some of the engagement portion 16 extends away from the clip portion in a second direction along the vertical axis 28. However, it should be appreciated that the clip portion 14 may be located at other positions relative to the engagement portion 16, such as at or proximate to a first end of the engagement portion 16 along the vertical axis 28 or a second end of the engagement portion 16 along the vertical axis 28.

As shown, the engagement portion 16 includes extensions 32 (e.g., vertically-extending extensions; prongs; wires) that are spaced apart from one another along the lateral axis 26 of the face mask support assembly 10. In particular, the extensions 32 are separated by gaps 34 (e.g., spaces) through which the ties 20 of the face mask 12 may pass. Because there are multiple extensions 32 each spaced apart from one another in this manner, each of the ties 20 may be looped around any of the multiple extensions 32 to thereby enable the user to adjust a tightness or fit of the face mask 12. The extensions 32 may extend across a width (e.g., an entire width; along the lateral axis 24) of the clip portion 14.

The face mask support assembly 10 and the face mask 12 may be applied onto the user via various techniques. For example, the user may first attach the face mask support assembly 10 to the hair of the user. Then, the user may place the face mask 12 on the face of the user and may pull each of the ties 20 to loop around the extensions 32. If the user wants to discard the face mask 12, the user may separate the face mask 12 from the face mask support assembly 10 by pulling the ties 20 through the gaps 34 to disengage from the extensions 32. The user may then couple another face mask to the same face mask support assembly 10. However, in some embodiments, the user may choose to discard the face mask support assembly 10 with the face mask 12. It should be appreciated that various other techniques are envisioned. For example, the face mask support assembly 10 and the face mask 12 may be coupled to one another (e.g., by looping the ties 20 about the extensions 32) prior to attachment of the face mask support assembly 10 to the hair 18 of the user.

Figure 3:
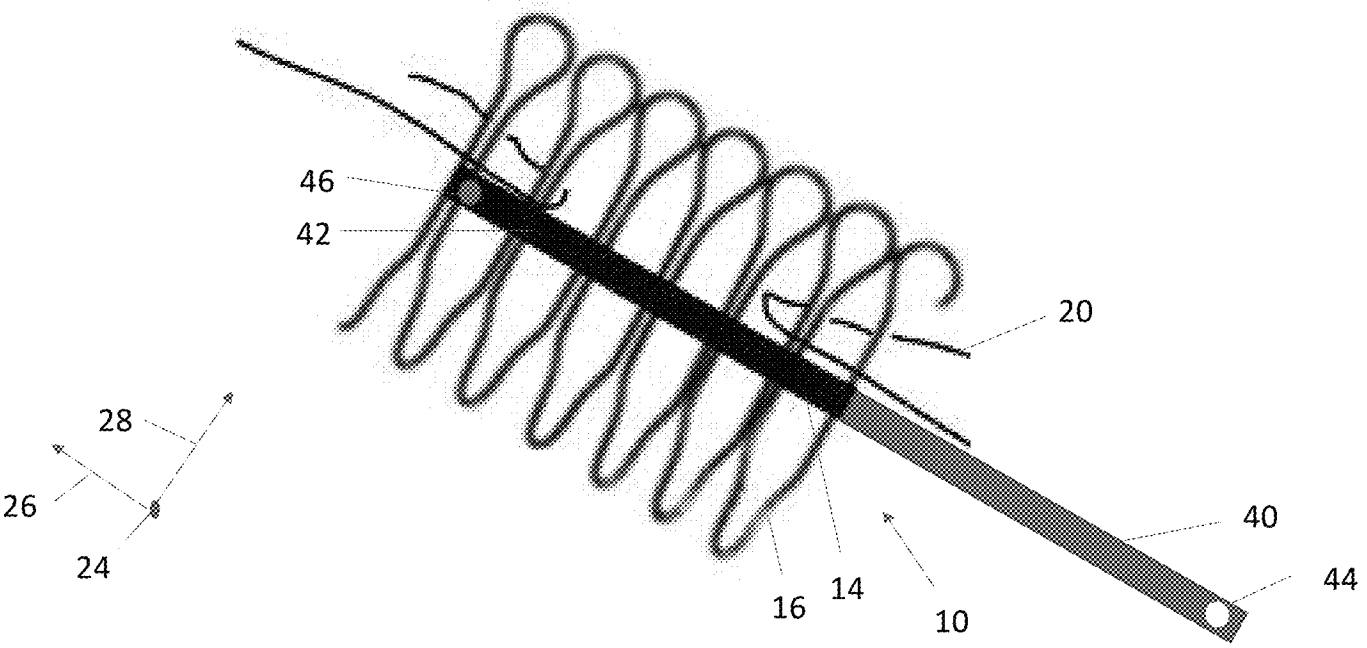
FIG. 3 is a perspective front view of the face mask support assembly of FIG. 2, in accordance with embodiments of the present disclosure.

FIG. 3 is a perspective bottom view of the face mask support assembly 10. As shown, the clip portion 14 of the face mask support assembly 10 is in an open configuration. To move from the open configuration of FIG. 3 to the closed configuration of FIG. 2, the user may rotate a first arm 40 relative to a second arm 42 in a first rotational direction. The first arm 40 and the second arm 42 may include a key-slot interface having a key 44 (which may be on one of the first arm 40 or the second arm 42) and a slot 46 (which may be on the other one of the first arm 40 or the second arm 42). When rotated to insert the key 44 into the slot 46, the clip portion 14 may remain in the closed position until some force is applied in a second rotational direction that is opposite the first rotational direction. Thus, the user may place the hair of the user in a space between the first arm 40 and the second arm 42, and then the user may rotate the first arm 40 relative to the second arm 42 until the key 44 is received within the slot 46 to thereby attach the face mask support assembly 10 to the hair of the user. The user may then couple the face mask to the face mask support assembly 10, as discussed above with respect to FIG. 1.

Figure 4:
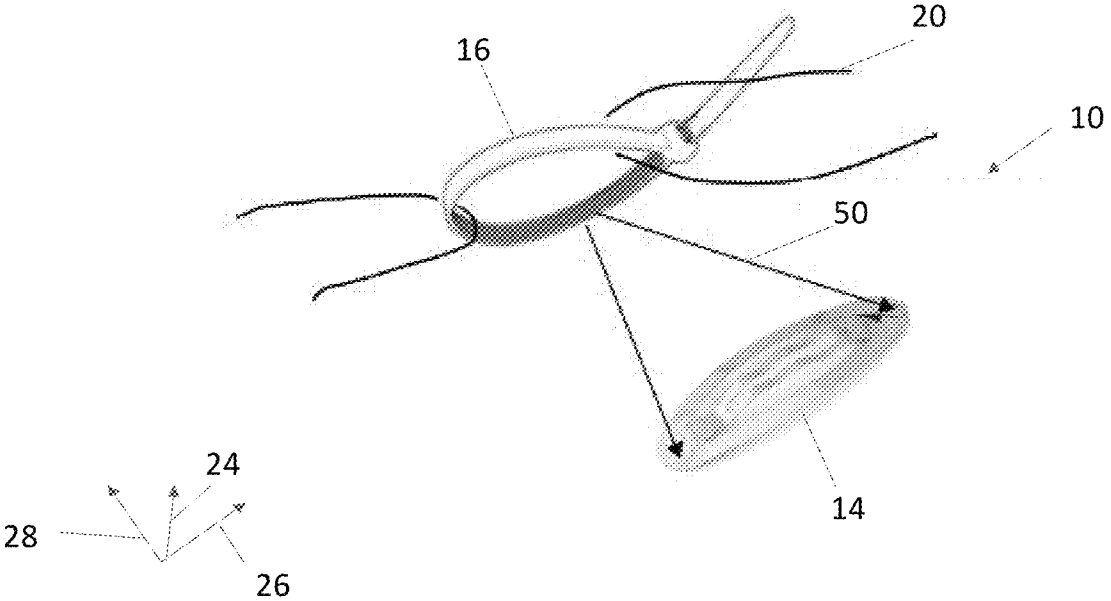
FIG. 4 is a perspective rear view of the face mask support assembly of FIG. 1, wherein the face mask support assembly includes a clip portion and a cable tie portion, in accordance with embodiments of the present disclosure.

FIG. 4 is a perspective rear view of an embodiment of the face mask support assembly 10 that may be used to couple the face mask to a user. As shown, the face mask support assembly 10 includes the clip portion 14 and the engagement portion 16, which is a cable tie portion (e.g., cable tie, such as a zip tie, wire harness, fastener). The clip portion 14 is configured to attach onto hair of the user, and the engagement portion is configured to engage ties 20 of the face mask to thereby couple the face mask to the user.

The clip portion 14 and the engagement portion 16 may be coupled to one another (e.g., via adhesive, welds, fasteners, or integrally-formed as one piece). For example, the engagement portion 16 may be coupled to lateral ends of the clip portion 14, as shown by arrows 50. The engagement portion 16 may extend from and/or may be positioned on a rear side of the clip portion 14 (e.g., stacked along the longitudinal axis 24; the rear side that faces away from the head of the user when the face mask support assembly 10 is on the user). However, the engagement portion 16 may be coupled to and/or may be positioned on other sides or surfaces of the clip portion 14.

The engagement portion 16 may be utilized to efficiently and/or effectively hold the ties 20 to the face mask support assembly 10. For example, the engagement portion 16 may include a ratchet and a flexible gear rack, and the flexible gear rack may be inserted through the ratchet to form a loop. Because the flexible gear rack may be inserted through the ratchet to varying degrees, the loop of the engagement portion 16 is adjustable and enables the user to adjust a tightness or fit of the face mask.

The face mask support assembly 10 and the face mask may be applied onto the user via various techniques. For example, the user may first engage the ties 20 with the engagement portion 16. Then, the user may attach the face mask support assembly 10 to the hair of the user via the clip portion 14, and the user may place the face mask on the face of the user. Finally, the user may adjust the engagement portion 16 to adjust the tightness or fit of the face mask. If the user wants to discard the face mask, the user may discard the face mask support assembly 10 with the face mask 12. It should be appreciated that various other techniques are envisioned. For example, the face mask support assembly 10 may be coupled to the hair of the user via the clip portion 14 prior to forming the engagement portion 16 into the loop to hold the ties 20.

Figure 5:
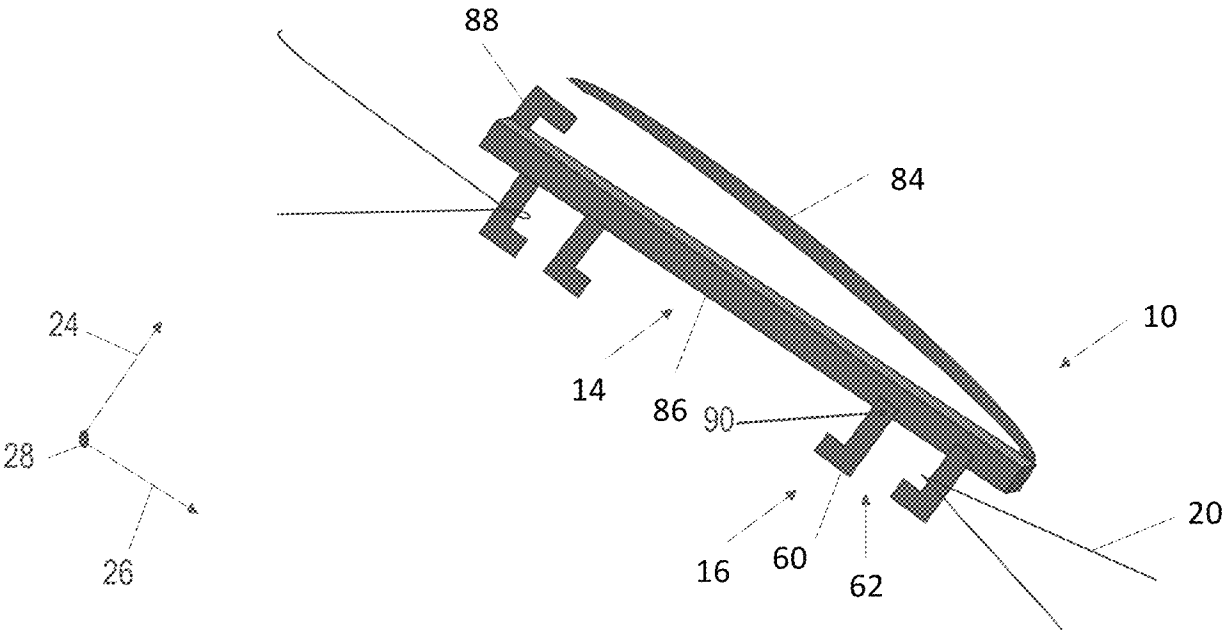
FIG. 5 is a perspective top view of the face mask support assembly of FIG. 1, wherein the face mask support assembly includes a clip portion and a prong portion, in accordance with an aspect of the present disclosure.

FIG. 5 is a perspective top view of an embodiment of the face mask support assembly 10 that may be used to couple the face mask to a user. As shown, the face mask support assembly 10 includes the clip portion 14 and the engagement portion 16, which may be a prong portion. The clip portion 14 is configured to clip into or attach onto hair of the user, and the engagement portion 16 is configured to engage ties 20 of the face mask to thereby couple the face mask to the user.

The clip portion 14 and the engagement portion 16 may be coupled to one another (e.g., via adhesive, welds, fasteners, or integrally-formed as one piece). The engagement portion 16 may include one or more prongs 60 that are positioned on and/or extend away from a rear side of the clip portion 15 (e.g., extend or stacked along the longitudinal axis 24; the rear side that faces away from the head of the user when the face mask support assembly 10 is on the user). However, it should be appreciated that the one or more prongs 60 may be extend from and/or may be positioned on another surface(s) of the clip portion 14 (e.g., extend or stacked along the vertical axis 28; a top surface). As shown, the one or more prongs 60 are have a bent shape (e.g., L-shaped) and are spaced apart from one another along the lateral axis 24 of the face mask support assembly 10. In particular, the one or more prongs 60 are separated by gaps 62 (e.g., spaces) through which the ties 20 of the face mask may pass. In embodiments having multiple prongs 60 each spaced apart from one another, the ties 20 may be looped around any of the multiple prongs 60 to thereby enable the user to adjust a tightness or fit of the face mask.

The face mask support assembly 10 and the face mask may be applied onto the user via various techniques. For example, the user may first attach the face mask support assembly 10 to the hair of the user. Then, the user may place the face mask on the face of the user and may pull each of the ties 20 to loop around the one or more prongs 60. If the user wants to discard the face mask, the user may separate the face mask from the face mask support assembly 10 by pulling the ties 20 through the gaps 62 to disengage from the one or more prongs 60. The user may then couple another face mask to the same face mask support assembly 10. However, in some embodiments, the user may choose to discard the face mask support assembly 10 with the face mask. It should be appreciated that various other techniques are envisioned. For example, the face mask support assembly 10 and the face mask may be coupled to one another (e.g., by looping the ties 20 about the one or more prongs 60) prior to attachment of the face mask support assembly 10 to the hair of the user.

As shown, the clip portion 14 of the face mask support assembly 10 is in an open configuration. To move from the open configuration of FIG. 5 to a closed configuration, the user may move a first arm 84 relative to a second arm 86 to engage an end of the first arm 84 with a bracket 88 of the second arm 86. Once the end of the first arm 84 is engaged with the bracket 88 of the second arm 86, the clip portion 72 may remain in the closed configuration until some force is applied to separate the end of the first arm 84 from the bracket 88 of the second arm 86. Thus, the user may place the hair of the user in a space between the first arm 84 and the second arm 86 and then may move the first arm 84 relative to the second arm 86 until the end of the first arm 84 is engaged with the bracket 88 of the second arm 86 to thereby attach the face mask support assembly 10 to the hair of the user.

The one or more prongs 60 may be fixed (e.g., non-moving) relative to the clip portion 14 (e.g., relative to the second arm 86 of the clip portion 14). However, in some embodiments, the one or more prongs 60 may be adjustable relative to the clip portion 14 (e.g., relative to the second arm 86 of the clip portion 14; between a first position and a second position). For example, each of the one or more prongs 60 may fold or pivot about a respective pivotable connection (e.g., pin) that couples the prong 60 to the clip portion 14 (e.g., to the second arm 86 of the clip portion 14). To facilitate discussion, one pivotable connection 90 is shown in FIG. 5.

The one or more prongs 60 may be adjustable relative to the clip portion 14 so that the one or more prongs 60 are flush with the clip portion 14 (e.g., flush with the second bar 86 of the clip portion 14) or otherwise do not protrude from the clip portion 14 in the second position. For example, the one or more prongs 60 may fold or pivot from the first position in which the one or more prongs 60 extend along a first axis, such as the longitudinal axis 24, to the second position in which the one or more prongs extend along a second axis, such as the lateral axis 26, and/or are stacked on the second bar 86 along the vertical axis 28. In some embodiments, the clip portion 14 (e.g., the second bar 86 of the clip portion 14) may include one or more recesses to receive the one or more prongs 60. In some embodiments, the one or more prongs 60 may not be visible and/or may not be able to hold the ties 20 while the one or more prongs 60 are in the second position. Advantageously, the adjustable aspects may enable the face mask support assembly 10 to operate as and appear to be a barrette or other structure that is configured to secure to hair while the one or more prongs 60 are in the second position, while still enabling the face mask support assembly 10 to operate to support the face mask while the one or more prongs 60 are in the second position. It should be appreciated that the one or more prongs 60 may be adjustable in other ways, such as to slide and to lock in different positions along the lateral axis 26.

It should be appreciated that the clip portions illustrated herein are merely provided as examples to facilitate discussion and that the face mask support assembly may include any suitable type of clip portion (e.g., snap clip, pinch clip, hinged barrette, spring-biased clips). It should also be appreciated that the engagement portions illustrated herein are merely provided as examples to facilitate discussion and that the face mask support assembly may include any suitable type of engagement portion in any suitable configuration that enables the engagement portion to engage and hold ties of the face mask. Furthermore, it should be appreciated that features of FIGS. 1-5 may be combined in any suitable manner. For example, the clip portion of FIG. 4 may be used with the engagement portions of FIG. 2, 3, or 5. In some embodiments, the face mask and the face mask support assembly may be provided together as a kit (e.g., face mask kit). Advantageously, the disclosed embodiments enable ties of the face mask to be held by the face mask support assembly rather than by ears of the user, thereby providing adjustable levels of tightness and fit, improving comfort, and the like.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C.

The invention claimed is:

1. A face mask support assembly, comprising:

a clip portion configured to attach to hair of a user; and an engagement portion coupled to the clip portion and comprising a plurality of prongs configured to engage one or more ties of a face mask to thereby support the face mask on the user, wherein prongs of the plurality of prongs are spaced apart from one another across a width of the clip portion to enable adjustment of a tightness of the face mask on the user, and the plurality of prongs is configured to enable the adjustment of the tightness of the face mask on the user from a first tightness via looping a first tie of the one or more ties about a first prong of the plurality of prongs to a second tightness via looping the first tie of the one or more ties about a second prong of the plurality of prongs.

2. The face mask support assembly of claim 1, wherein the engagement portion comprises a comb with the plurality of prongs.

3. The face mask support assembly of claim 1, wherein the plurality of prongs extend from a top surface of the clip portion.

4. The face mask support assembly of claim 1, wherein the plurality of prongs is configured to engage the one or more ties of the face mask via looping the one or more ties about respective prongs of the plurality of prongs.

5. The face mask support assembly of claim 1, comprising respective gaps defined between adjacent prongs of the plurality of prongs, wherein the respective gaps are configured to receive respective ties of the one or more ties of the face mask to engage the one or more ties of the face mask.

6. The face mask support assembly of claim 1, wherein the prongs of the plurality of prongs have a bend to facilitate holding the one or more ties.

7. A face mask kit, comprising:

a clip portion configured to attach to hair of a user; and an engagement portion coupled to the clip portion and configured to engage a first tie and a second tie of a face mask to thereby support the face mask on the user, wherein the engagement portion is configured to enable adjustment of respective positions of the first tie and the second tie of the face mask relative to the clip portion to adjust a tightness of the face mask on the user, the engagement portion comprises a plurality of prongs configured to enable the first tie and the second tie of the face mask to be looped around respective prongs of the plurality of prongs, and the prongs of the plurality of prongs are configured to pivot relative to the clip portion to be movable relative to the clip portion.

8. The face mask kit of claim 7, wherein the engagement portion comprises the plurality of prongs spaced apart from one another across a width of the clip portion, and the plurality of prongs enable the first tie and the second tie of the face mask to be selectively looped around respective prongs of the plurality of prongs to enable the adjustment of the respective positions of the first tie and the second tie of the face mask relative to the clip portion to adjust the tightness of the face mask on the user.

9. The face mask kit of claim 7, comprising the face mask comprising the first tie on a first lateral side of the face mask and the second tie on a second lateral side of the face mask.

10. A method of applying a face mask to a user, the method comprising:

coupling a clip portion of a face mask support assembly to hair of the user;

positioning the face mask on a face of the user;

engaging a first tie and a second tie of the face mask with an engagement portion of the face mask support assembly, wherein the engagement portion is coupled to the clip portion and comprises a plurality of prongs configured to engage the first tie and the second tie of the face mask to thereby support the face mask on the user, and prongs of the plurality of prongs are spaced apart from one another across a width of the clip portion to enable adjustment of a tightness of the face mask on the user; and adjusting, via the engagement portion, the tightness of the face mask on the user from a first tightness via looping the first tie about a first prong of the plurality of prongs to a second tightness via looping the first tie about a second prong of the plurality of prongs.

11. The method of claim 10, comprising further adjusting the tightness of the face makes on the user via adjusting the engagement portion that holds the first tie and the second tie of the face mask.

12. The method of claim 10, comprising engaging the first tie and the second tie of the face mask with the engagement portion of the face mask support assembly prior to coupling the clip portion of the face mask support assembly to the hair of the user.

13. The method of claim 10, comprising discarding the face mask and the face mask support assembly after use.

* * * * *